US005438642A

United States Patent [19]

Posen

[11] Patent Number: 5,438,642

[45] Date of Patent: Aug. 1, 1995

[54] INSTANTANEOUS WATER HEATER

[75] Inventor: Alan Posen, Littleton, Colo.

[73] Assignee: Instantaneous Thermal Systems, Inc., Denver, Colo.

[21] Appl. No.: 90,316

[22] Filed: Jul. 13, 1993

[51] Int. Cl.[6] ..... F24H 1/10; H05B 1/02

[52] U.S. Cl. ..... 392/485; 392/486; 392/488; 392/491; 392/497; 219/483; 122/13.2

[58] Field of Search ..... 219/483–488, 219/497, 494; 392/485–494; 122/13.2, 448.3

[56] References Cited

U.S. PATENT DOCUMENTS

| | | | |
|---|---|---|---|
| 2,686,863 | 8/1954 | Chandler | 392/490 |
| 3,446,939 | 5/1969 | Morgan | 392/490 |
| 4,713,525 | 12/1987 | Eastep | 219/308 |
| 4,835,365 | 5/1989 | Etheridge | 219/298 |
| 5,216,743 | 6/1993 | Seitz | 322/490 |
| 5,325,822 | 7/1994 | Fernandez | 122/13.2 |

FOREIGN PATENT DOCUMENTS

| | | | |
|---|---|---|---|
| 0929049 | 5/1982 | U.S.S.R. | 392/491 |

*Primary Examiner*—Mark H. Paschall

*Attorney, Agent, or Firm*—Charles C. Corbin

[57] ABSTRACT

A heater for the rapid heating of water includes a main body having plural vertical upwardly opening chambers, combined with a molded cover plate that can be removably installed over the upper part of the main body. A plurality of combination heating and chamber partition assemblies extend downwardly from the bottom surface of the installed cover plate and one each of the assemblies resides in a main body chamber, each assembly including a generally flat and vertically elongated partition member and a pair of heating coils mounted to each partition member, one each coil on opposite sides of the partition member, and each partition member cooperates with a chamber to form a first channel for conducting water downwardly and a second channel for conducting water upwardly. There is a water inlet to a first of the chambers and an outlet from a last of the chambers, and the lower edges of the partition members are spaced from the chamber bottoms to form flow paths between first and second channels, and the tops of the chambers are spaced from the bottom of the cover plate to provide flow paths between a channel of one chamber and a channel of an adjacent chamber.

3 Claims, 2 Drawing Sheets

INSTANTANEOUS WATER HEATER

TECHNICAL FIELD

This invention relates to the art of water heaters that heat water flowing through the heater and do not provide storage for the heated water.

BACKGROUND

So-called instantaneous water heaters are known. These heaters generally provide for rapid heating of water as it flows through the heater and are in contrast to other types of heaters that heat water at a relatively slow rate and provide storage for heated water. Instantaneous water heater can be either "open" or "closed." An open system is placed at the outlet of a water line and services a single outlet, while a closed system is placed in a water line that includes a plurality of separately controlled outlet valves.

U.S. Pat. No. 4,638,147 (Dytch et al.) shows, for example, an open flow-through heater that includes a plurality of heating elements in a single chamber, the elements being switched on to effect a predetermined heating. The flow rate is measured by a turbine, and the output of the heating elements is determined by a microprocessor that, in turn, controls a number of triacs connected to the heating elements.

U.S. Pat. No. 4,604,515 (Davidson) shows another water heater wherein a chamber has a plurality of baffles for creating a serpentine flow path. U.S. Pat. No. 4,410,791 (Eastep) discloses an instantaneous water heater having a heating element comprised of a plurality of heating plates molded into the water heater core. A number of tapered ceramic projections extend into the flow path and between the heating plates to provide a serpentine flow over the plates. U.S. Pat. No. 4,713,525 (Eastep) teaches an improved control for the '791 patent.

Other instantaneous water heater systems are shown in U.S. Pat. Nos. 4,808,793 (Hurko), 5,020,127 (Eddas), and 5,129,034 (Syndenstricker).

SUMMARY OF THE INVENTION

The basic element of the water heater in accordance with the invention is a body that is preferably injection molded of plastic. The body has an inlet cylinder for receiving water from a supply and an outlet cylinder for discharging heated water to a conduit connected, for example, to a lavatory faucet. A plurality heat exchange chambers are formed between the inlet and outlet cylinders for directing the flow of water. There are preferably three of these chambers to allow use of single or three phase current without load balancing. The body includes a top plate that supports an electric heating element extending into each of the chambers and, in selected embodiments, a fin for directing the flow of water in the chamber. The heat exchange chambers are elongate, and the electric heating elements extend along the longitudinal axis. The electric heating elements may be any of several different types, e.g., ceramic elements, open elements, sheathed elements, encapsulated elements and cartridge-type elements.

In the preferred embodiment, a flow rate measuring device is placed in the inlet cylinder for accurately measuring the flow rate. The temperature of the water entering the heater is measured and the temperature of the water leaving the heater is optionally measured. The flow rate measurement and the water temperatures are supplied to a microprocessor that is programmed to determine the precise amount of energy required to heat the water to the desired outlet temperature at that particular flow rate. Thus, the water heater is effective even when connected to a plurality of outlets that are operated intermittently and at variable flow rates.

Preferably, the microprocessor subtracts the inlet temperature from the desired outlet temperature, or set point. It can then determine the exact amount of energy required to heat the water to the desired temperature for the current flow rate. If the flow rate changes, the microprocessor immediately determines the new energy requirement and causes the heaters to supply that.

The heaters are controlled by triacs for effective control of the energy supplied to the water. The triacs can be duty cycled in a zero-crossing mode without a Radio Frequency Filter (RFI) or cycled in a proportional mode with RFI filters. Because the triac is a bi-directional device, the duty cycle modulation occurs at 120 Hz.

The heater of the invention is preferably operated as a closed system, but it may be configured as an open system. In either embodiment, the pressure drop across the inlet and outlet is less than 1.5 psi, which allows it to be used in gravity feed systems with pressures as low as 2.8 psi.

The water flow rate can be detected by a magnetic on/off switch, which eliminates the need for the microprocessor and operates as a full output unit. Preferably, however, the flow rate is accurately measured, and that rate is supplied to the microprocessor. The flow rate is preferably measured by a paddle wheel that is placed in the flow path and has magnetic elements on the paddles, the speed of the wheel being determined by a Hall effect sensor. The paddle wheel flow rate sensor has the advantage that the paddles can be quite long for any given space available for the sensor. That is, only a part of the water wheel actually extends into the water flow, the remainder being in a cavity displaced from the flow. These features allow the sensing elements to be farther apart, when compared, for example, with a turbine, resulting in increased sensitivity. Other flow rate measuring devices may be used, however, such as optical systems and floats that rise with increasing flow rate.

The microprocessor is preferably programmed to provide individual control of each of the elements. In one embodiment, a look up table is used to determine the proportion of maximum power based on the required temperature rise. Thus, a 10 KW element may be controlled to produce 50% power for a predetermined temperature increase and proportionally greater amounts for larger temperature increases. The microprocessor may also be programmed to control the heating element differently for different flow rates and for different uses of the heater. Thus, the heater may be controlled to turn on at one flow rate for one use (e.g., a lavatory) and at another flow rate for another use (e.g., a radiant heater).

DETAILED DESCRIPTION OF THE INVENTION

Figure 4:
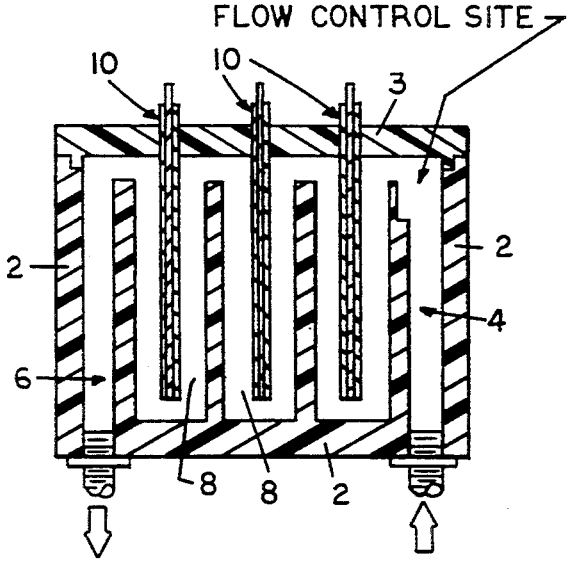
FIGS. 4 through 6 are, respectively, transverse cross sections of embodiments of the water heater shown in FIG. 2 having different heating elements.

With reference to FIGS. 1 through 4, a heater in accordance with the invention comprises a body 2 that is, preferably, injection molded and includes an inlet cylinder 4 and an outlet cylinder 6. Three heating chambers 8 are located intermediate the inlet and outlet cylinders, and each of these chambers has a heating element extending into the center of the chamber. The chambers are generally cylindrical and are connected to each other at the tops of the chambers. In the preferred embodiment, the heating chambers are generally cylindrical and may have diameters of from $\frac{7}{8}''$ to $1\frac{1}{8}''$. The inlet cylinders must have diameters equal to the inlet piping (not shown), such as $\frac{3}{8}''$. In addition, the cross sectional area between the diving walls and the top of the heater must be at least that of the $\frac{3}{8}''$ inlet to avoid flow restrictions.

Figure 6:
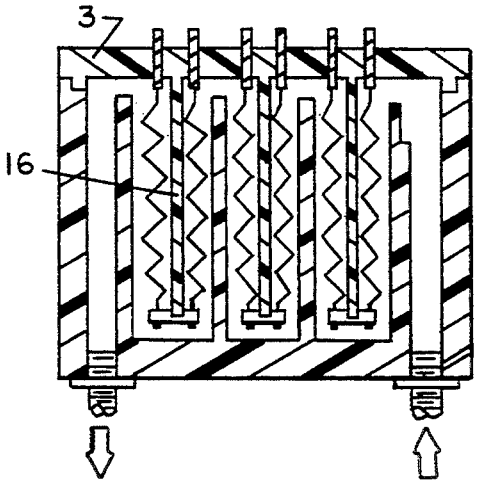
Figure 2:
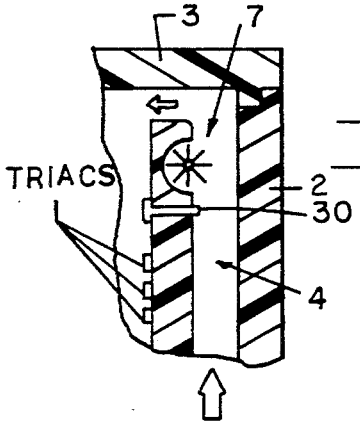
FIGS. 1 through 3 are longitudinal cross sections, respectively, of first, second and third embodiments of a water heater in accordance with the invention.
Figure 5:
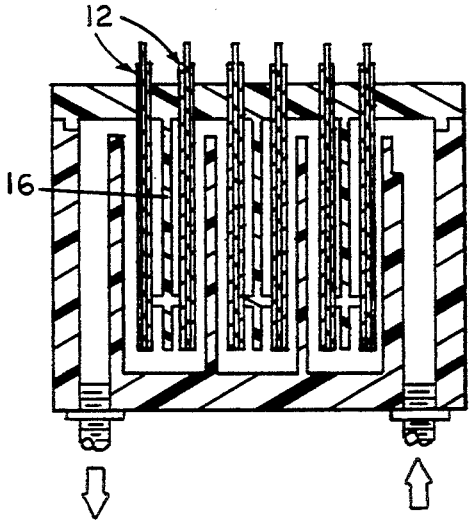
Figure 1:
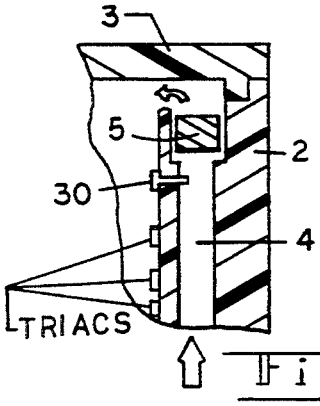
Figure 3:
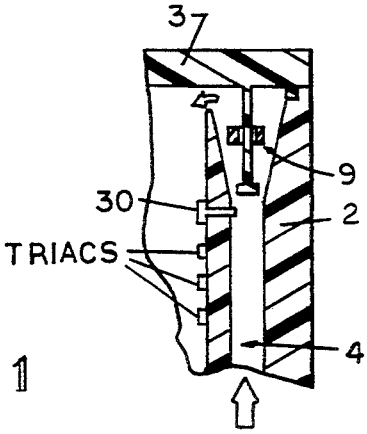

The body 2 is closed by a top 3 that supports the heating elements and, in the embodiments shown in FIGS. 5 and 6, the top also supports the fins, or baffles, that extend into the chambers.

The inlet cylinder includes a location for mounting any of several different types of flow rate sensors. The type illustrated in FIG. 1 comprises a magnet 5 that closes a reed switch (not shown) as the magnet rises in response to the water flow to turn the power on or off. The sensor shown in FIG. 2 comprises a paddle wheel that operates in conjunction with a Hall effect probe 36 (see FIG. 7) or coil to provide a very sensitive flow rate measurement. An inductive coil sensitive to the movement of the magnets in the paddles may also be used. FIG. 9 illustrates magnet that moves upward by an amount that is a function of the rate of flow, the position of the magnet being detected by a Hall effect sensor as well.

The electric heating elements are arranged in the heating chambers such that water flowing into a chamber flows generally downward along one side of the heating element, between the bottom of an element and the bottom of the chamber, and upward along the other side of the heating element. Thus, the flow is serpentine, which increases the contact between the heating elements and the flow of water.

The heating elements may be of several types and are either flat to provide baffle-like performance or are combined with a vertical baffle for providing the serpentine flow path. For example, when the heating elements are formed of a single ceramic substrate 10, as shown in FIG. 4, the substrate is preferably flat and extends across the heating chamber to cause the water to flow down one side, under the plate, and up the other side for efficient heat conduction.

With reference to FIG. 5, each of the heating elements includes two ceramic substrates 12 and a baffle 16 is held between respective pairs of ceramic heating elements. The heating plates in this instance do not extend across the chamber and the water flows across the individual ceramic elements and around their sides. The baffles direct the water such that it flows across the inside of a first of the plates and then across the inside of the opposing plate.

The open coil heating elements illustrated in FIG. 6 are combined with baffles 16 that are supported by the top 3 to cause the water to flow down one side of the element and up the other.

Figure 7:
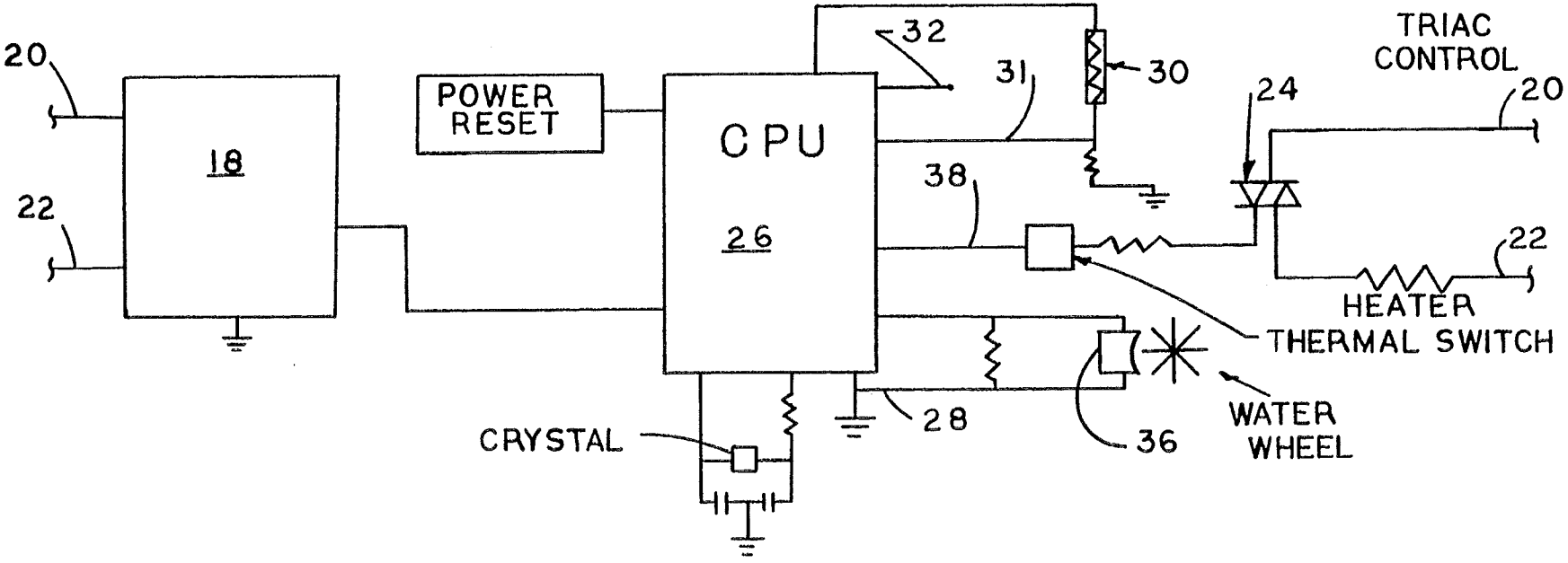
FIG. 7 is a schematic circuit diagram of a control circuit in accordance with the invention.

An illustrative electronic control circuit is shown in FIG. 7. A power supply 18 includes a bridge rectifier and a synchronizing output line. The output lines 20 and 22 of the rectifier are connected to the inputs of each of the triac elements 24 (also see FIGS. 1–3) to provide power to the heating elements. A microprocessor 26 receives an input from the flowmeter at line 28. The inlet temperature sensor 30, which is preferably a thermistor and a balance resistor provides an input at line 31. The desired water temperature is supplied at line 32, which is preferably connected to a potentiometer (not shown) for adjustability.

The flow meter illustrated in FIG. 7 includes a Hall effect probe 36, which detects the passage of the magnets in the paddles of the paddle wheel sensor.

The microprocessor 26 calculates the precise amount of power required to raise the water flowing through the heater to the desired set temperature. This calculation is straightforward and will not be described in detail here. The result of the calculation is supplied to line 38, which is in turn connected to the triacs 24 to adjust the amount of power supplied by the lines 20 and 22 to the electric heating elements.

It will be appreciated that a unique instantaneous heater has been described. The same basic construction can be used for a variety of systems, including the simple on/off system and the microprocessor controlled system. Moreover, the construction permits all parts to be easily replaced in the field. Modifications within the scope of the appended claims will be apparent to those of skill in the art.

I claim:

1. An instantaneous water heater including:

a) a main body having an upper portion in which is provided a plurality of vertically extending cylindrical chambers, each said chambers having a bottom and an open top, and said chambers aligned in a row, and said body including water inlet means for a first chamber of said row and water outlet means connected to a last chamber of said row; and b) a cover plate, having a bottom surface, and mountable to said body upper portion to form a fluid-tight seal therewith, and said plate having a plurality of spaced-apart combination partition and heating means extending downwardly from said plate bottom, said combination means comprising a vertically elongated partition member having a lower edge, and a heating coil pair mounted to each of said members, one each of said coils secured to opposite sides of each partition member, and whereby said cover plate has an installed position in which said combination means is received in a one of said chambers whereby the partition member cooperates with said chamber to form a first channel for conducting a downward water flow, and an adjacent channel for conducting an upward water flow, one of said coil pair disposed in said first channel, and the other coil disposed in said second channel, and said member lower edge spaced from said chamber bottom to form a flow path between lowerparts of said channels, and the tops of said chambers spaced from the bottom of said cover plate to provide flow paths between a channel of one chamber and a channel of an adjacent chamber.

2. A heater as defined in claim 1 including hanger means secured adjacent the lower edge of each of said partition members, and one end of each said coils secured to said cover plate and the other end secure to said hanger means.

3. A heater as defined in claim 2 wherein there are three of said chambers.

* * * * *